US012760616B2

(12) United States Patent
Schultz

(10) Patent No.: US 12,760,616 B2
(45) Date of Patent: Oct. 13, 2026

(54) PLUG RELEASE IN A SUBTERRANEAN WELL

(71) Applicant: THRU TUBING SOLUTIONS, INC., Newcastle, OK (US)

(72) Inventor: Roger L. Schultz, Ninnekah, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 18/986,847

(22) Filed: Dec. 19, 2024

(65) Prior Publication Data

US 2025/0207472 A1 Jun. 26, 2025

Related U.S. Application Data

(60) Provisional application No. 63/613,937, filed on Dec. 22, 2023.

(51) Int. Cl.
*E21B 33/12* (2006.01)
*E21B 23/10* (2006.01)

(52) U.S. Cl.
CPC ..... *E21B 33/1208* (2013.01); *E21B 23/10* (2013.01); *E21B 2200/08* (2020.05)

(58) Field of Classification Search
CPC ..... E21B 23/0413; E21B 34/142; E21B 2200/08; E21B 33/1208; E21B 33/1277; E21B 23/10
See application file for complete search history.

(56) References Cited

U.S. PATENT DOCUMENTS

| | | | | |
|---|---|---|---|---|
| 6,220,360 | B1 * | 4/2001 | Connell | E21B 23/00 166/373 |
| 6,776,228 | B2 * | 8/2004 | Pedersen | E21B 33/05 166/75.15 |
| 6,802,372 | B2 * | 10/2004 | Budde | E21B 33/16 166/381 |
| 11,834,919 | B2 | 12/2023 | Schultz et al. | |
| 12,146,378 | B2 | 11/2024 | Tucker et al. | |
| 2005/0039925 | A1 * | 2/2005 | Connell | E21B 23/042 166/373 |
| 2013/0319668 | A1 * | 12/2013 | Tschetter | E21B 43/261 166/281 |
| 2014/0238746 | A1 * | 8/2014 | Radford | E21B 41/00 175/57 |
| 2015/0068771 | A1 * | 3/2015 | Richards | E21B 23/06 166/386 |

(Continued)

*Primary Examiner* — Yanick A Akaragwe
(74) *Attorney, Agent, or Firm* — Smith IP Services, P.C.

(57) ABSTRACT

A method for use with a subterranean well can include connecting at least one plug release tool in a tubular string, and deploying a plug into the tubular string, thereby releasing another plug from the plug release tool. Multiple plug release tools can be connected in the tubular string to control actuation of multiple well tools connected in the tubular string. A plug release tool can include an outer housing having a fluid inlet and a fluid outlet, a piston releasably secured against displacement in the housing, the piston having a flow passage therein configured to permit fluid flow from the fluid inlet to the fluid outlet, a plug configured to block fluid flow through the flow passage, and another plug configured to be released from the outer housing in response to displacement of the piston relative to the outer housing.

38 Claims, 3 Drawing Sheets

(56) References Cited

U.S. PATENT DOCUMENTS

| | | | | |
|---|---|---|---|---|
| 2016/0201414 | A1* | 7/2016 | Nikiforuk | E21B 23/10 166/72 |
| 2017/0175487 | A1* | 6/2017 | Marcin | E21B 33/12 |
| 2021/0372230 | A1* | 12/2021 | Palmer | E21B 34/14 |
| 2021/0396088 | A1* | 12/2021 | Schultz | E21B 31/113 |
| 2022/0090470 | A1* | 3/2022 | Pugliese | E21B 43/127 |

* cited by examiner

PLUG RELEASE IN A SUBTERRANEAN WELL

CROSS-REFERENCE TO RELATED APPLICATION

This application claims the benefit of the filing date of U.S. provisional application No. 63/613,937 filed on 22 Dec. 2023. The entire disclosure of this prior application is incorporated herein in its entirety for all purposes.

BACKGROUND

This disclosure relates generally to equipment utilized and operations performed in conjunction with a subterranean well and, in an example described below, more particularly provides for release of one or more plugs in a subterranean well.

A variety of different techniques are used to activate downhole tools in wells. In many circumstances, it is desirable to selectively activate one or more particular downhole tools at different stages of a well operation.

Therefore, it will be readily appreciated that improvements are continually needed in the art of activating downhole tools in subterranean wells. These improvements can be utilized in a wide variety of different well operations and systems.

DETAILED DESCRIPTION

Figure 1:
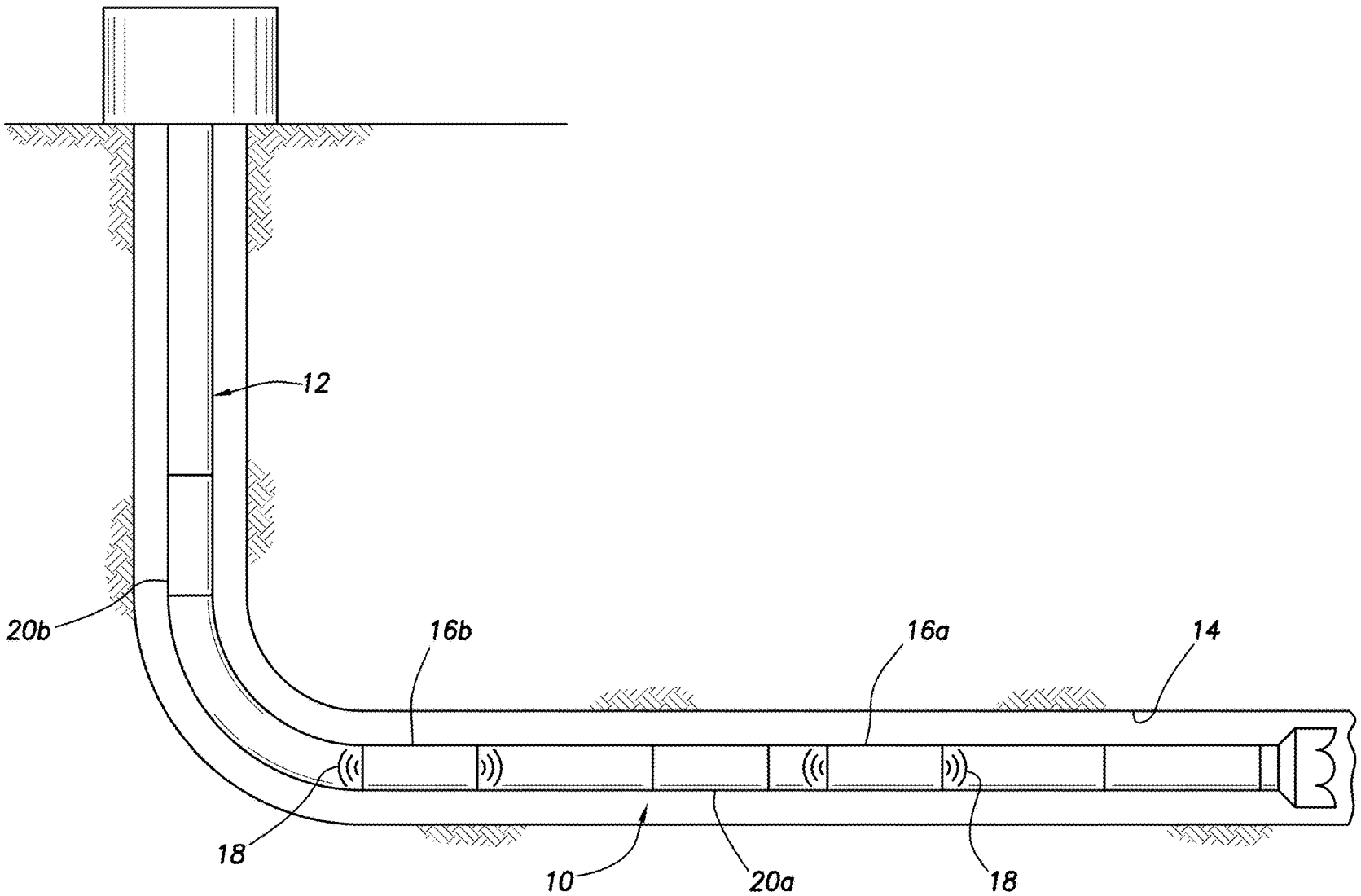
FIG. 1 is a representative partially cross-sectional view of an example of a well system and associated method which can embody principles of this disclosure.

Representatively illustrated in the accompanying figures is an apparatus, system and associated method which can embody principles of this disclosure. However, it should be clearly understood that the apparatus, system and method are merely one example of an application of the principles of this disclosure in practice, and a wide variety of other examples are possible. Therefore, the scope of this disclosure is not limited at all to the details of the apparatus, system and method described herein and/or depicted in the drawings.

One use of the apparatus or downhole tool of this disclosure is to allow a first plug released from above the apparatus to cause the apparatus to release a second plug of the same or a different size (larger or smaller) which can move downhole below the apparatus. Additionally, a first plug can be pumped through this apparatus without releasing the second plug by sizing a seat in the apparatus such that the first plug can pass through the seat. Viewed from a different perspective, the first plug can be selected to be smaller than the seat in the apparatus.

As used herein, the term "plug" is used to indicate a plugging device used to block flow through a fluid passage. Other types of plugging devices (such as, darts, balls, any of the plugging devices described in U.S. Pat. No. 10,851,615, etc.) may be used in place of either of the first and second plugs described herein. The scope of this disclosure is not limited to use of any particular type of plugging device for the first or second plug described herein.

Multiple tools of this type can be run in a same tubular string (for example, with each tool having a different seat size) and other plug actuated tools can be run in the same tubular string, as well. If multiple tools with different seat sizes are connected in a same tubular string, the seat sizes may be progressively smaller toward a distal end of the tubular string.

Figure 2:
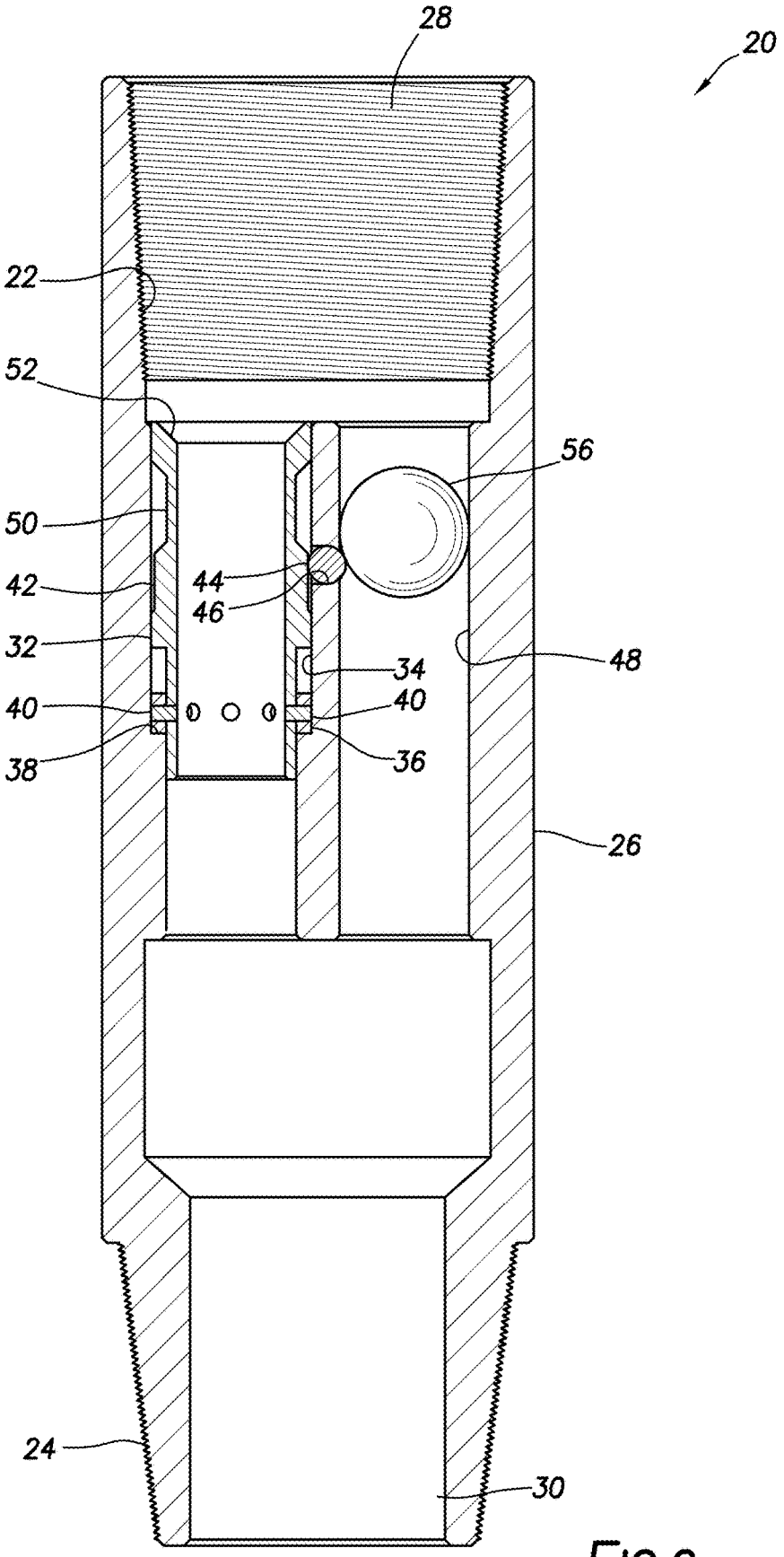
FIG. 2 is a representative cross-sectional view of a plug release tool that may be used with the FIG. 1 system and method, the tool being in a run-in configuration.

FIG. 2 depicts one example tool design in a "run-in" configuration. The second plug is prevented from moving by a small ball or other retainer member (such as, a dog, pin, rod, or other retaining structure) that is held in place by a piston, which can be shifted downward (as viewed in FIG. 2). Fluid can flow through a fluid passage extending axially through the piston in the FIG. 2 run-in configuration.

In the FIG. 2 example, the piston is maintained in its run-in position by a ring which is secured to the piston by shear pins or other release members (such as, a shear ring, collets, a snap ring, etc.). The scope of this disclosure is not limited to use of any particular type of release device or member to releasably secure the piston.

When a first plug is pumped from the surface or other uphole location, it will land on a seat in a top of the piston, thereby blocking fluid flow through the fluid passage in the piston. Fluid pressure applied from the surface or other uphole location will create force on the piston, causing the shear pins to shear, thereby allowing the piston to move downward relative to the ring and an outer housing of the tool.

Figure 3:
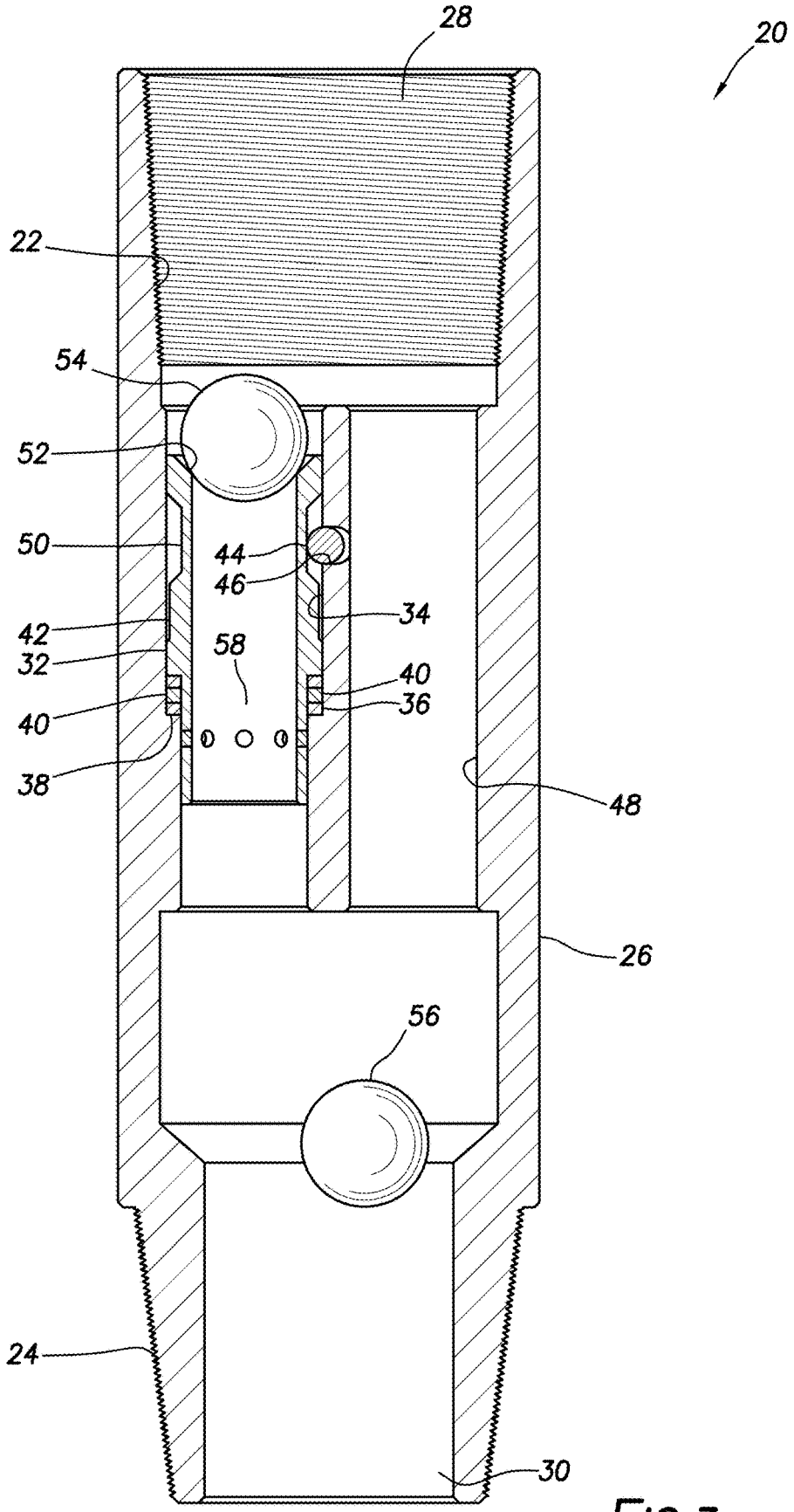
FIG. 3 is a representative cross-sectional view of the plug release tool in an actuated configuration.

In the shifted position, the small ball which restrains the movement of the second plug can move into a recess on the piston allowing the second plug to move down in the tool and exit the lower end of the tool. FIG. 3 depicts an example of the tool in an actuated configuration.

This tool allows a second plug of a different size and/or material to be released downhole using a first plug of a specific size or material (such as, configured to engage the seat and block flow through the piston flow passage). This method/tool can be configured to use plugging devices of types other than a ball geometry, or combinations of plugging devices. Additionally, the first and/or second plugs can be made of dissolvable materials.

One application of this tool would be with vibratory tools that have plug "pass-through" capability. These vibratory tools are designed such that they can be activated by pumping a plug from above the tool (the surface for instance) which lands in the tool and activates it in some way to start causing vibration. These vibratory tools can also be configured such that a sufficiently small plug can pass through an upper vibratory tool and land in a lower vibratory tool to selectively activate the lower tool without activating the upper tool.

Some examples of vibratory tools with pass-thru capability include those described in U.S. Pat. Nos. 9,957,765 and 10,837,249, the entire disclosures of which are incorporated herein by this reference in their entireties for all purposes. An example of a vibratory tool without pass-thru capability is described in U.S. Pat. No. 11,525,307, the entire disclosure of which is incorporated herein by this reference in its entirety for all purposes.

Several vibratory tools can be run in a single tubular string and sequentially activated as desired. The plug release apparatus/tool described in this disclosure can be placed above and/or between vibratory tools as described previously to facilitate deploying plugs above the vibratory tools to activate them. The plug release and vibratory tools can be configured with appropriately sized seats to allow balls deployed from above one or more of these tools to pass through both the ball release tools and vibratory tools as desired.

Referring specifically now to FIG. 1, an example of a system 10 and associated method which can embody principles of this disclosure is representatively illustrated. The system 10 and method are used in this example to enhance running of a tubular string 12 through a horizontal section of a wellbore 14 in a drilling operation by selective activation of multiple vibratory tools 16*a,b* connected in the tubular string. However, the principles of this disclosure are not limited to any particular type of well operation, to operation in a horizontal section of a wellbore, to the use of multiple vibratory tools, or to any particular type of well tool to be activated.

Note that the vibratory tools 16*a,b* are only one example of a type of well tool that may be activated in response to release of a plug from a plug release tool connected in the tubular string 12. For example, other types of well tools could include reamers, fluid samplers, valves, etc. Any type of well tool may be used in place of the vibratory tools 16*a,b* in keeping with the principles of this disclosure.

As depicted in FIG. 1, multiple plug release tools 20*a,b* are connected in the tubular string 12. In this example, one of the plug release tools 20*a,b* is connected uphole of each of the vibratory tools 16*a,b*. Thus, the plug release tools 20*a,b* and the vibratory tools 16*a,b* are alternated along the tubular string 12.

It is not necessary in keeping with the principles of this disclosure for the vibratory tools 16*a,b* and the plug release tools 20*a,b* to be alternated along the tubular string 12. Two of each of the plug release tools 20*a,b* and the vibratory tools 16*a,b* are depicted in FIG. 1, but any number of these tools (including only one of each type of tool) may be used in other examples.

Due to increased friction between the tubular string 12 and the wellbore 14 in the horizontal section, it is desired to activate one or both of the vibratory tools 16*a,b*. When activated, the vibratory tools 16*a,b* will produce vibrations 18 (comprising impacts or fluid pulses in some examples), for example, in response to fluid flow through the vibratory tools.

However, it is beneficial in some circumstances to be able to selectively activate the vibratory tools 16*a,b*. For example, it may be desired to initially activate the vibratory tool 16*a* when the tubular string 12 is deployed a certain distance into the horizontal section of the wellbore 14, and then to activate the vibratory tool 16*b* when the tubular string is deployed a greater distance into the horizontal section.

The plug release tools 20*a,b* include features that provide for releasing plugs from the respective plug release tools in order to activate corresponding vibratory tools 16*a,b*. In this manner, each of the vibratory tools 16*a,b* can be selectively activated when desired.

Referring additionally now to FIG. 2, a representative cross-sectional view of a plug release tool 20 that may be used with the FIG. 1 system 10 and method is depicted. The FIG. 2 plug release tool 20 may be used for the FIG. 1 plug release tools 20*a,b*. However, the FIG. 2 plug release tool 20 may be used with other systems and methods in keeping with the principles of this disclosure.

As depicted in FIG. 2, the plug release tool 20 is in a run-in configuration. The plug release tool 20 can be connected in a tubular string and deployed into a well in this configuration. Upper and lower threaded connections 22, 24 are provided for this purpose in the FIG. 2 example.

The upper and lower threaded connections 22, 24 are formed on an outer housing 26 at respective fluid inlet 28 and fluid outlet 30 ends of the outer housing. However, note that fluid can flow into or out of either of the inlet 26 and outlet 28 in different phases of a well operation. The terms "inlet" and "outlet" are only used in this example to refer to a fluid flow direction during actuation of the plug release tool 20, as described more fully below.

An annular piston 32 is releasably secured in a bore 34 formed in the outer housing 26. In this example, a ring 36 surrounds the piston 32 and abuts a shoulder 38 formed in the bore 34, and release members 40 extend through the ring and the piston to prevent downward displacement of the piston relative to the outer housing 26. In this example, the release members 40 are shear members (such as, shear pins, shear screws, a shear ring, etc.), but in other examples other types of release members (such as, collets, dogs, latches, etc.) may be used to releasably secure the piston 32.

An outer surface 42 formed on the piston 32 outward supports a retainer member 44 received in an opening 46 formed between the bore 34 and another bore 48 formed in the outer housing 26. In this example, the retainer member 44 is in the form of a ball, but in other examples other types of retainer members (such as, a collet, a dog, etc.) may be used.

Another outer surface 50 formed on the piston 32 is positioned so that it will be aligned with the retainer member 44 when the piston is displaced downward in the bore 34. In this example, the outer surfaces 42, 50 comprise outer diameters of the piston 32, with the outer surface 42 being at a larger outer diameter than the outer surface 50, but in other examples other configurations of the outer surfaces may be used.

A seat 52 is formed at an upper end of the piston 32. The seat 52 is shaped so that it can sealing engage a plug 54 (see FIG. 3) deployed into a tubular string uphole of the plug release tool 20. In this example, the seat 52 is in the form of a frusta-conical surface at the upper end of the piston 32, but in other examples the seat could have other shapes (such as, a bore, etc.) and could be otherwise positioned (such as, near a middle or lower end of the piston).

With the retainer member 44 outwardly supported by the piston outer surface 42 as depicted in FIG. 2, a plug 56 is prevented from displacing downwardly through the bore 48. The bore 48 in this example extends between the inlet 28 and the outlet 30. The retainer member 44 extends into the bore 48 to obstruct the plug 56 and thereby prevent it from being carried with fluid flow through the bore to the outlet 30.

The plug 56 is sized to activate a well tool (such as, one of the vibratory tools 16*a,b* in the FIG. 1 system 10 and method) downhole from the plug release tool 20 after the plug is released from the tool 20. The plug 56 may be sized to pass through one or more well tools before being received in a particular well tool which the plug will activate. For example, the plug 56 could have a diameter that is less than a diameter needed to activate one or more well tools downhole of the plug release tool 20, but the plug can eventually be received in a well tool configured to be activated in response to receiving the plug therein.

Referring additionally now to FIG. 3, a representative cross-sectional view of the plug release tool 20 in an actuated configuration is depicted. The plug 54 has been deployed into a tubular string uphole of the plug release tool 20, and the plug 54 has eventually entered the inlet 28 and then sealingly engaged the seat 52. Fluid flow through the tubular string may be used to assist in displacing the plug 54 through the tubular string to the plug release tool 20.

The plug 54 blocks fluid flow through a flow passage 58 that extends longitudinally through the piston 32. A predetermined pressure differential can then be applied across the plug 54 and piston 32 (such as, by applying increased pressure to the tubular string uphole of the plug release tool 20) to release the release members 40 (such as, by shearing shear pins or a shear ring, releasing collets or a latch, etc.). The pressure differential displaces the piston 32 downward (as viewed in FIG. 3) to its actuated position.

With the piston 32 in its downwardly displaced position, the outer surface 42 of the piston 32 no longer supports the retainer member 44. Instead, the smaller outer surface 50 on the piston 32 is aligned with the retainer member 44, which allows the retainer member to retract through the opening 46. In this position, the retainer member 44 no longer prevents downward displacement of the plug 56 through the bore 48.

The plug 56 displaces downward through the bore 48 and the outlet 30, and is carried by fluid flow through the tubular string downhole of the plug release tool 20. Eventually, the plug 56 will be received in a well tool (such as one of the FIG. 1 vibratory tools 16*a,b*) for activation of that well tool. The plug 56 may be sized to pass through one or more well tools, and then be received in a well tool with, for example, a seat sized to sealingly engage the plug 56.

In the FIG. 3 example, the plugs 54, 56 are the same size. However, in other examples the plug 54 may be smaller or larger than the plug 56. One or both of the plugs 54, 56 may be made of a dissolvable or otherwise degradable material, so that after the plug release tool 20 has been actuated or another well tool has been activated by one of the plugs, one or both of the plugs will degrade and permit unrestricted flow through the flow passage(s) formerly blocked by the plug(s).

A material of the plug 54 may be different from a material of the plug 56. For example, one of the plugs 54, 56 may comprise a degradable material and the other plug may comprise a non-degradable material. One of the plugs 54, 56 may comprise an elastomer material and the other plug may comprise a metal material. It is not necessary for the plugs 54, 56 to share any particular characteristic, except that both are used to block flow through a respective flow passage.

It may now be fully appreciated that the above disclosure provides significant advancements to the art of activating downhole tools in subterranean wells. In examples described above, the plug release tool 20 enables actuation of a well tool (such as, the vibratory tools 16*a,b*) by deploying a first plug 54 into a tubular string 12 uphole of the plug release tool, thereby causing a second plug 56 to be released from the plug release tool.

The above disclosure provides to the art a method for use with a subterranean well. In one example, the method can comprise: connecting at least one plug release tool 20 in a tubular string 12; and deploying a first plug 54 into the tubular string 12, thereby releasing a second plug 56 from the plug release tool 20.

The deploying step may include receiving the first plug 54 in the plug release tool 20. The receiving step may include sealingly engaging the first plug 54 with a seat 52 of the plug release tool 20.

The sealingly engaging step may include blocking flow through a piston 32 of the plug release tool 20. The method may include applying a predetermined pressure differential across the first plug 54 after the sealingly engaging step.

The releasing step may be performed in response to applying a predetermined pressure differential across the first plug 54. The method may include displacing a piston 32 of the plug release tool 20 in response to the predetermined pressure differential applying step. The releasing step may be performed further in response to the piston 32 displacing step.

A size of the first plug 54 may be different from a size of the second plug 56. A diameter of the first plug 54 may be different from a diameter of the second plug 56.

A material of the first plug 54 may be different from a material of the second plug 56. At least one of the first and second plugs 54, 56 may comprise a material degradable or dissolvable in the well.

The "at least one" plug release tool 20 may comprises multiple plug release tools 20*a,b*. The connecting step may include connecting the multiple plug release tools 20*a,b* in the tubular string 12.

Respective seats 52 of the multiple plug release tools 20*a,b* may have different sizes. The connecting step may include connecting the multiple plug release tools 20*a,b* in the tubular string 12 so that the seat 52 sizes decrease in a downhole direction.

The method may include connecting multiple well tools 16*a,b* in the tubular string 12, actuating a first one of the well tools 16*a* by the second plug device 56 released from a first one of the plug release tools 20*a* connected uphole of the first well tool 16*a*, and actuating a second one of the well tools 16*b* by the second plug device 56 released from a second one of the plug release tools 20*b* connected uphole of the second well tool 16*b*. The well tools 16*a,b* may comprise vibratory tools.

Another method for use with a subterranean well can comprise: connecting at least first and second plug release tools 20*a,b* and at least first and second well tools 16*a,b* in a tubular string 12; deploying a first plug 54 into the tubular string 12, thereby releasing a second plug 56 from the first plug release tool 20*a*; and deploying a third plug 54 into the tubular string 12, thereby releasing a fourth plug 56 from the second plug release tool 20*b*.

A size of the third plug 54 may be different from a size of the first plug 54. A diameter of the third plug 54 may be different from a diameter of the first plug 54. A diameter of the third plug 54 may be greater than a diameter of the first plug 54.

A size of the fourth plug 56 may be different from a size of the second plug 56. A diameter of the fourth plug 56 may be different from a diameter of the second plug 56.

The first plug release tool 20*a* may comprise a first seat 52. The first plug 54 deploying step may include sealingly engaging the first plug 54 with the first seat 52.

The second plug release tool 20*b* may comprise a second seat 52. The third plug 54 deploying step may include sealingly engaging the third plug 54 with the second seat 52. A size of the first seat 52 may be different from a size of the second seat 52.

The method may include actuating the first well tool 16*a* in response to the second plug 56 releasing step, and actuating the second well tool 16*b* in response to the fourth plug 56 releasing step.

Also provided to the art by the above disclosure is a plug release tool 20 for use in a subterranean well. In one example, the plug release tool 20 can comprise: an outer housing 26 having a fluid inlet 28 and a fluid outlet 30; a piston 32 releasably secured against displacement in the housing 26, the piston 32 having a flow passage 58 therein configured to permit fluid flow from the fluid inlet 28 to the fluid outlet 30; a first plug 54 configured to block fluid flow through the flow passage 58; and a second plug 56 configured to be released from the outer housing 26 in response to displacement of the piston 32 relative to the outer housing 26.

The first plug 54 may be configured to sealingly engage a seat 52. The seat 52 may be formed on the piston 32.

The plug release tool 20 may include a retainer member 44 that selectively prevents and permits release of the second plug 56 from the outer housing 26. The retainer member 44 may be configured to permit release of the second plug 56 in response to displacement of the piston 32.

In a first position of the piston 32, the retainer member 44 may prevent release of the second plug 56 from the outer housing 26. In a second position of the piston 32, the retainer member 44 may permit release of the second plug 56 from the outer housing 56. The piston 32 may be configured to displace from the first position to the second position in response to a predetermined pressure differential applied across the piston 32.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method for use with a subterranean well, the method comprising:

connecting a fluid outlet of at least one plug release tool to a downstream portion of a tubular string;

connecting a fluid inlet of the at least one plug release tool to an upstream portion of the tubular string;

then conveying the plug release tool into the subterranean well via the tubular string, whereby fluid is permitted to flow through the plug release tool from the upstream portion of the tubular string to the downstream portion of the tubular string; and then deploying a first plug into the tubular string, thereby releasing a second plug from the plug release tool.

2. The method of claim 1, in which the deploying further comprises receiving the first plug in the plug release tool.

3. The method of claim 2, in which the receiving comprises sealingly engaging the first plug with a seat of the plug release tool.

4. The method of claim 3, in which the sealingly engaging comprises blocking flow through a piston of the plug release tool.

5. The method of claim 4, further comprising applying a predetermined pressure differential across the first plug after the sealingly engaging.

6. The method of claim 1, in which the releasing is performed in response to applying a predetermined pressure differential across the first plug.

7. The method of claim 6, further comprising displacing a piston of the plug release tool in response to the predetermined pressure differential applying.

8. The method of claim 7, in which the releasing is performed further in response to the piston displacing.

9. The method of claim 1, in which a size of the first plug is different from a size of the second plug.

10. The method of claim 1, in which a diameter of the first plug is different from a diameter of the second plug.

11. The method of claim 1, in which a material of the first plug is different from a material of the second plug.

12. The method of claim 1, in which at least one of the first and second plugs comprises a material degradable in the well.

13. The method of claim 1, in which at least one of the first and second plugs comprises a material dissolvable in the well.

14. The method of claim 1, in which the at least one plug release tool comprises multiple plug release tools, and in which the connecting comprises connecting the multiple plug release tools in the tubular string.

15. The method of claim 14, in which respective seats of the multiple plug release tools have different sizes.

16. The method of claim 15, in which the connecting further comprises connecting the multiple plug release tools in the tubular string so that the seat sizes decrease in a downhole direction.

17. The method of claim 14, further comprising connecting multiple well tools in the tubular string, actuating a first one of the well tools by the second plug released from a first one of the plug release tools connected uphole of the first well tool, and actuating a second one of the well tools by the second plug released from a second one of the plug release tools connected uphole of the second well tool.

18. The method of claim 17, in which the well tools comprise vibratory tools.

19. A method for use with a subterranean well, the method comprising:

connecting at least first and second plug release tools and at least first and second well tools in a tubular string;

deploying a first plug into the tubular string, thereby releasing a second plug from the first plug release tool; and deploying a third plug into the tubular string, thereby releasing a fourth plug from the second plug release tool.

20. The method of claim 19, in which a size of the third plug is different from a size of the first plug.

21. The method of claim 19, in which a diameter of the third plug is different from a diameter of the first plug.

22. The method of claim 19, in which a diameter of the third plug is greater than a diameter of the first plug.

23. The method of claim 19, in which a size of the fourth plug is different from a size of the second plug.

24. The method of claim 19, in which a diameter of the fourth plug is different from a diameter of the second plug.

25. The method of claim 19, in which the first plug release tool comprises a first seat, and in which the first plug deploying comprises sealingly engaging the first plug with the first seat.

26. The method of claim 25, in which the second plug release tool comprises a second seat, in which the third plug deploying comprises sealingly engaging the third plug with the second seat, and in which a size of the first seat is different from a size of the second seat.

27. The method of claim 19, further comprising actuating the first well tool in response to the second plug releasing, and actuating the second well tool in response to the fourth plug releasing.

28. A plug release tool for use in a subterranean well, the plug release tool comprising:

an outer housing having a fluid inlet and a fluid outlet;

first and second parallel flow passages configured to permit fluid flow from the fluid inlet to the fluid outlet;

a piston releasably secured against displacement in the outer housing, the piston having the first flow passage therein;

a first plug configured to block fluid flow through the first flow passage; and a second plug configured to be released from the second flow passage in response to displacement of the piston relative to the outer housing.

29. The plug release tool of claim 28, in which the first plug is configured to sealingly engage a seat.

30. The plug release tool of claim 29, in which the seat is formed on the piston.

31. The plug release tool of claim 28, further comprising a retainer member that selectively prevents and permits release of the second plug from the outer housing.

32. The plug release tool of claim 31, in which the retainer member is configured to permit release of the second plug in response to displacement of the piston.

33. The plug release tool of claim 31, in which in a first position of the piston the retainer member prevents release of the second plug from the outer housing, in which in a second position of the piston the retainer member permits release of the second plug from the outer housing, and in which the piston is configured to displace from the first position to the second position in response to a predetermined pressure differential applied across the piston.

34. The plug release tool of claim 28, in which a size of the first plug is different from a size of the second plug.

35. The plug release tool of claim 28, in which a diameter of the first plug is different from a diameter of the second plug.

36. The plug release tool of claim 28, in which a material of the first plug is different from a material of the second plug.

37. The plug release tool of claim 28, in which at least one of the first and second plugs comprises a material degradable in the well.

38. The plug release tool of claim 28, in which at least one of the first and second plugs comprises a material dissolvable in the well.

* * * * *